US006902525B1

(12) United States Patent
Jewell

(10) Patent No.: US 6,902,525 B1
(45) Date of Patent: Jun. 7, 2005

(54) DUAL-MOTION AUTO-STIMULATION DEVICE

(76) Inventor: Stephen W. Jewell, 840 Davis Rd., League City, TX (US) 77573

( * ) Notice: Subject to any disclaimer, the term of this patent is extended or adjusted under 35 U.S.C. 154(b) by 0 days.

(21) Appl. No.: 10/748,818

(22) Filed: Dec. 30, 2003

(51) Int. Cl.[7] ..... A61H 19/00
(52) U.S. Cl. ..... 600/38
(58) Field of Search ..... 601/97, 101–103, 601/112–114, 109, 120, 123, 125, 126, 129, 601/130, 135, 137; 600/38–41, 33–35; 446/236, 446/240, 241, 246; 74/22 R, 23, 24, 55, 57

(56) References Cited

U.S. PATENT DOCUMENTS 2,081,796 A * 5/1937 Delvin ..... 74/22 R
4,089,229 A * 5/1978 Geraci ..... 74/57
5,676,497 A * 10/1997 Kim ..... 408/21
6,632,185 B2 * 10/2003 Chen ..... 601/101

* cited by examiner

*Primary Examiner*—Samuel G. Gilbert

(57) ABSTRACT

A device designed to take rotary power from an external power source such as a cordless electric screwdriver and transmit that energy into both rotary and reciprocating linear activation of sexual devices used by both males and females for the purpose of masturbation and auto-stimulation is disclosed. The combination of rotational stimulation with reciprocating linear stimulation is apparently remarkably satisfying despite the absence of such stimulation during normal person-on-person sexual contact. The device is simple, light weight, small, powerful, modestly priced, handheld or hands-free, user serviceable, hygienic, gender neutral, sexual orientation neutral, convenient, rugged, multi-motion, safe, reliable, quiet, fully submersible, positionally versatile and sexually satisfying.

14 Claims, 3 Drawing Sheets

DUAL-MOTION AUTO-STIMULATION DEVICE

BACKGROUND OF THE INVENTION

1. Field of the Invention

The present invention relates to the field of sexual devices used by both males and females for the purpose of sexual auto-stimulation. In particular, the invention relates to mechanical devices adapted to transmit rotary energy into both rotary and reciprocating linear activation for the purpose of masturbation and/or stimulation of one's partner during sexual play.

Various known devices for stimulating the female genitalia have been developed for the purpose of providing sexual gratification and climax during sexual intercourse, foreplay, and masturbation. Generally, they are used for personal pleasure and recreation by providing the user healthy sexual outlets. They are sometimes used in combination with sex-therapy programs. The sexual devices can provide the user an opportunity for sexual exploration and development, alleviate fears and anxiety about sexual performance, aid in the development of one's sensual capacities, and even facilitate verbal, emotional and sexual communication between sex partners. The most common form of such device is the vibrator, which operates by applying pressure, friction, and vibration to the clitoral region, walls of the vagina and/or external areas of the genitalia.

There are far fewer devices available for male auto-stimulation. These are principally soft elastomer sleeves into which the penis is inserted and manually massaged.

2. Description of the Background Art

The need and demand for products used for sexual self-satisfaction and/or to increase satisfaction between couples, be they heterosexual or homosexual, can be illustrated by the plethora of product offerings filling sex shops and adult stores, and orderable online from literally thousands of Internet retailers.

A routine search on a popular search engine was conducted to search the Internet for the single term "sex toys" in quotes (so as not to get hits related to either "sex" OR "toys" by itself) and got 800,000 hits. For comparison purposes, the term "sleeping bag" returned 363,000 hits, and "bowling ball" returned a paltry 93,000. A survey of the first five pages (50 hits) was conducted to see how many of the hits were retailers as opposed to other types of sites. 42 of the first 50 hits (84%) were sites selling sex toys. If these 50 sites can be taken as representative of the rest, then there may be as many as 672,000 sites where something inanimate can be purchased to stimulate and/or enhance sexual pleasure. An estimated half of these sites are in North America. Clearly, there is a large demand, and a large supply, of devices for use in sexual stimulation.

One not so subtle site lists the sales volume of their 300 bestsellers over a reported two-month period in 2002. In the top spot is the "Ravenous Rabit", a purple dildo/vibrator for her that sold 1063 units at $34.00. In 300th position was the Bullfighter Pump, a vacuum penis pump operated by a hand-held squeezable bulb, which sold 48 units at $27.00. The full product catalog lists over 2100 products ranging in price from $5890.00 for a life-like silicon love doll with all the appropriate lovemaking equipment to a $4.00 edible condom.

When one multiplies the reported unit volume by the unit price for just the 300 purported top sellers at the "Sextoys" site, we find a sales volume of just over $US700,000.00. And this is for only a reported two months of sales by a single online retailer, who apparently has another 1800 products whose sales were not reported.

Of course, not all sex products for sale are devices. Many are lotions and lubricants, condoms, lingerie, and other sexual paraphernalia. Of those that can be considered auto-erotic stimulating devices, many or most are hand held and or operated. These include silicon and other soft plastic elastomer sleeves for penile stimulation and many non-operating penis substitutes intended for vaginal and rectal insertion. Those that actually provide some form of mechanical stimulation usually do so with small internal motors generating predominantly vibratory action operating on two, three or four AA or AAA batteries. Like their un-powered cousins, the user is expected to impart most of the intercourse simulating motion.

There are a few dildos that claim linear thrusting in the head of the device but, to the extent these claims are true, this action is not a close intercourse simulation. We claim there are very few natural penises so talented as to alternatively grow and shrink in length to any substantive degree while inserted in a vagina.

For both men and women, what is required to simulate the act of copulation involves rather long strokes of the entire device that terminate near full insertion. This is not to suggest that other forms of stimulation like vibration and rotation are not also appropriate for auto-stimulation, but simply to point out that they have not routinely been a part of one-on-one human sexual contact over our evolutionary history and therefore not the first choice from the menu.

These mass-marketed devices retail from as little as ten dollars for a simple small vibrator up into the sixty to eighty dollar range for more sophisticated machines. They are almost without exception less than $100 in America. Overall, they may be characterized as cheap, fragile, underpowered, gender specific, single action, often unhygienic when badly insulated internal electrical components prevent proper washing by means of submersion, unserviceable by the user, and disappointingly unsatisfying sexually. No sexual partner need worry about losing their mate's affection to any of these machines.

The background paragraph of U.S. Pat. No. 6,142,929, issued to Padgett in November of 2000, states, "There exists a need for a cheap, effective, safe, private, disease free, non impregnating, and natural like way for a woman to achieve sexual gratification with a sexual stimulation apparatus." While this may be correct, the statement's applicability ought to be extended to the males of our species as well. A machine very similar to the one described by Padgett is currently being marketed. It is called the "Jetaime", and can be found on the Internet at (http://wwwjetaime.to/jetaime-.htm). Unfortunately the quoted price of this machine as of this writing is $US1195.00, hardly inexpensive and not readily available for every would-be self-satisfier.

There is another class of machines more capable of simulating intercourse. These are known colloquially but rather descriptively as 'the fucking machines'. Most of these machines do have long and adjustable stroke length and many are featured on the manufacturer's Internet Website. Their actions are derived by numerous methods including pneumatic, hydraulic, and mechanical. We mentioned the Jetaime and its price earlier. One manufacturer in Texas called TFM manufacturers sells nine different machines. For the least expensive 'Mini Custom TFM' prices begin at $US650.00. Pricing on the most expensive machine begins at $1700 with most of the machines in the $1000 to $1400 range. Prices begin here because like all the other manufacturers of these devices, this one custom manufactures each machine by hand to the happy owner's specifications.

There are two machines that reportedly are very popular. The Sybian is a machine designed for females that the woman sits atop and is penetrated by a mechanically actuated dildo. Two motors provide differing action; one vibration and a second a peculiar form of rotation. The dildo doesn't actually revolve within the user but the top sweeps through a circular arc while the base remains stationary. The inventors (Abco Research Associates) self-report on their website manufacturing and selling 'hundreds' of Sybians at $1400 since 1987. This is one of the few dual-action machines presently available.

A second product for male users is sold by Abco Research. It is called the Venus and is a patented device (U.S. Pat. No. 5,501,650 issued to Gellert in March 1996). This device is a pneumatically operated penile sleeve. A reciprocating pump causes the air pressure on the outside of the sleeve to rise and fall so that the sleeve moves up and down on the penis of the user. The Venus 2000 receives glowing reviews, but sells for $955 and is once again single action, and is of course gender specific.

Inventive minds have been hard at work building machines that provide sexual release. Nevertheless, we characterize this second collection of Sow volume custom built machines as large, heavy, cumbersome, expensive, powerful, often noisy, gender specific, generally unserviceable by unskilled user, single action, unhygienic, and in many cases plainly dangerous.

A third class of machines are those that were not sexual stimulation devices by design, but are instead machines built for other purposes and put to novel use. The "Fucksall" is simply a reciprocating saw found in many home workshops to which a dildo is attached. These machines typically provide about two inches or less of stroke. In another innovative twist, the "Drilldo" is simply a dildo attachment device with a ¼ inch hex drive on the back such that the user can attach an electric drill or other rotary energy source thereby causing the dildo to rotate inside the male or female orifice of preference. Any linear stroke must be manually provided by the user.

The attachment mechanism used on the Drilldo to connect to the dildo is not unique to this device. The adapter is an industry standard connection called the Vac-U-Loc that fits an entire line of dildos offered by Doc Johnson (Health Devices Corp. doing business as), one of the largest manufacturers of sexual devices. The fact that this prominent manufacturer maintains this line of products, which are functional only when connected to another device, suggests that there are a large number of various sexual devices to which these stimulation devices might be attached.

The Drilldo and a few similar items do provide rotational stimulation, which users appear to find satisfying despite the absence of such stimulation during normal person-on-person sexual contact over our evolutionary development. In fact this type of stimulation is difficult to attain between two sexual partners.

Once again, inventive minds have worked on this articulation problem. The "sex swing" (18,200 internet hits) offers the standard answer. One website offers six different models all from different manufacturers. The swings are either supported from the ceiling or some other overhead structure or may be purchased with purpose-designed and marketed freestanding frames. They provide for one sexual partner to be suspended in slings of various designs attached to the overhead structure by spring or bungee cords. While there are many sexual positions suggested as effective for use with swings, there is only one practical one in which rotational stimulation (in conjunction with linear thrust afforded by the springs or bungee) is possible. This of course is with one partner suspended directly above the other where the suspended partner can be freely rotated. Swings themselves are modestly priced ($100 to $250) as sophisticated sexual aids go, but they are difficult to set up, get suspended in, and put away out of the children and neighbors' sight. There is the added danger in the aforementioned configuration that an equipment failure, ceiling or ceiling attachment failure, or a simple slip by the suspended partner within the sling might end the session with catastrophic consequences. Swings are an extreme measure to resort to in order to experience simultaneous insertion and rotation.

For all these reasons there exists a need for a device that provides both rotary and linear reciprocating activation of sexual devices used by both males and females for the purpose of sexual stimulation. Such a device would be desirable only if it could be convenient, simple and safe, easy to handle, light and small, yet powerful and still be modestly priced, rugged, reliable and satisfying.

SUMMARY OF THE INVENTION

Figure 1:
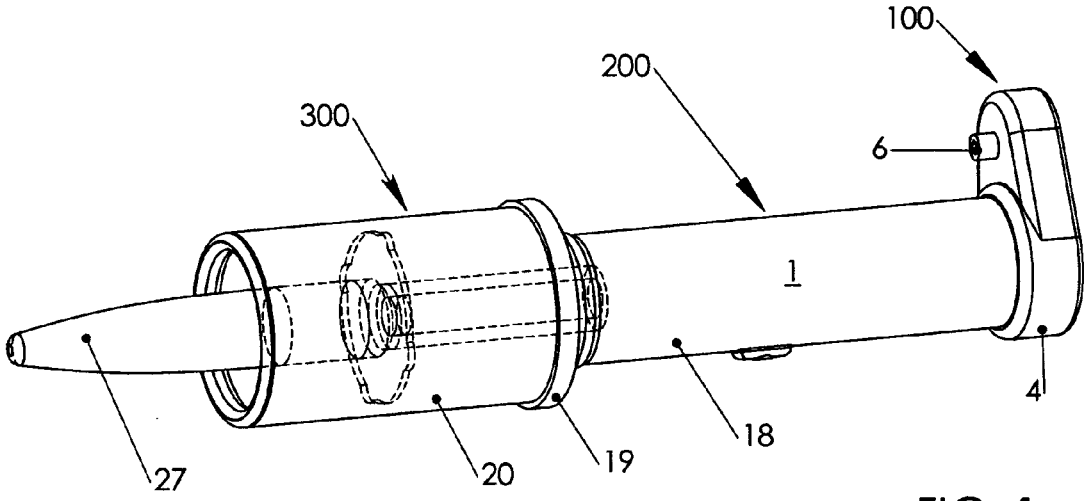
FIG. 1 shows a perspective view of the assembled device of the invention in its female configuration. The dotted lines are added to show how the female attachment is connected to the oscillating drive train shuttle within the protective housing.

The present invention provides a light weight, portable, multi-motion device that provides all of the above characteristics and, in addition, is adapted for handheld or hands-free operation, thereby enhancing sexual activity and providing satisfying sexual stimulation. The device may be fabricated in a cost effective and simple manner and thus will be relatively inexpensive while still being rugged, reliable, hygienic, quiet, fully submersible and positionally versatile. The device is simple and easy to use and operate requiring little instruction.

It is a feature of the present invention that a device made according to the invention is capable of being adapted to provide mechanical stimulation to the genitalia of a woman or a man and thus is gender and sexual orientation neutral.

It is also a feature of the present invention that a device made according to the invention can take rotary power and transmit that energy into rotary and linear reciprocating activation of sexual devices used by both males and females for the purpose of sexual stimulation. In the embodiment most thoroughly described below, rotary power is provided from an external power source such as a cordless electric screwdriver or drill.

The invention is embodied in a portable, lightweight, hand held apparatus, adapted to be used by both males and females, for producing simultaneous rotating and linearly reciprocating motion and transmitting such motion to a suitable self stimulation masturbation device for the purpose of sexual self stimulation.

In this embodiment, the invention comprises a power transmission assembly including a drive shaft, connection means associated with the drive shaft and adapted to receive rotational energy from an external rotating power source and transfer that energy to enable rotation of the drive shaft, and attachment means, affixed to the distal end of the drive shaft, and adapted to attach to and transmit motion from the drive shaft to a selected suitable self stimulation device.

An optional, but important, element of the invention is a stand-off assembly, adapted to keep the operating components of the power transmission assembly and the stimulation device safely away from the user.

The power transmission assembly represents the key to the unique motion of the present invention. It comprises a linear actuation assembly adapted to receive rotary motion from the drive shaft; and rotary energy transmission means associated with the drive shaft to transmit rotary energy from the drive shaft to the linear actuation assembly.

In a preferred embodiment, the linear actuation assembly comprises a generally tube-shaped outer protective transmission housing, a transmission fork within the housing that is fixedly attached to the drive shaft; and a cammed shuttle connected to the transmission fork and adapted to receive rotational energy therefrom. The shuttle is adapted to fit within the transmission housing and to move linearly therein. A cam follower is fixedly mounted to engage the cammed shuttle and induce linear reciprocation of the shuttle within a confined space as it simultaneously rotates.

The shuttle, in its preferred form, has at least one suitably configured cam groove cut into the outer surface thereof. A corresponding cam follower is mounted on the transmission housing and adapted to engage the cam groove in the shuttle and thereby induce linear reciprocation of the shuttle following the profile of the groove when the shuttle rotates.

A rotatable transmission fork is slidably located within the linear shuttle and fixed in place laterally relative to the transmission assembly housing. It is attached to and receives rotational motion from an appropriate rotary energy transmission means, such as a gear box assembly associated with the power connection and the drive shaft. The transmission fork is designed and adapted such that rotation of the laterally fixed transmission fork is transmitted to the shuttle, but the shuttle is still free to move linearly within the transmission housing.

The attachments assembly, affixed to the distal end of the power transmission assembly so as to move in synchrony with the active components of the power transmission assembly, is made to connect with and transmit motion of the device to a suitably selected stimulation mechanism. In its preferred form, the attachments assembly includes a universal adapter, suitable to receive and attach to a multiplicity of self stimulation devices.

A stand-off assembly, adapted to keep the operating components of the power transmission assembly and the stimulation device safely away from the user, is included with the preferred embodiment of the apparatus of this invention. The preferred form of such stand-off assembly includes a tube adapted to be secured in place on the distal end of the power transmission assembly and fit over the selected stimulation mechanism, be it male or female, to protect the user from injury.

DETAILED DESCRIPTION OF THE INVENTION

The device of the present invention is designed to take rotary power from an external power source, such as a cordless electric screwdriver or the like, and transmit that energy into both rotary and reciprocating linear activation of sexual devices used by both males and females for the purpose of masturbation.

FIG. 1 shows the assembled device with the attachments assembly configured for use by females. The female stimulation device 27 is shown attached to the device of the invention but is not part of the invention. The attachments assembly for the male configuration is longer and includes a few additional pieces discussed further below.

Figure 2:
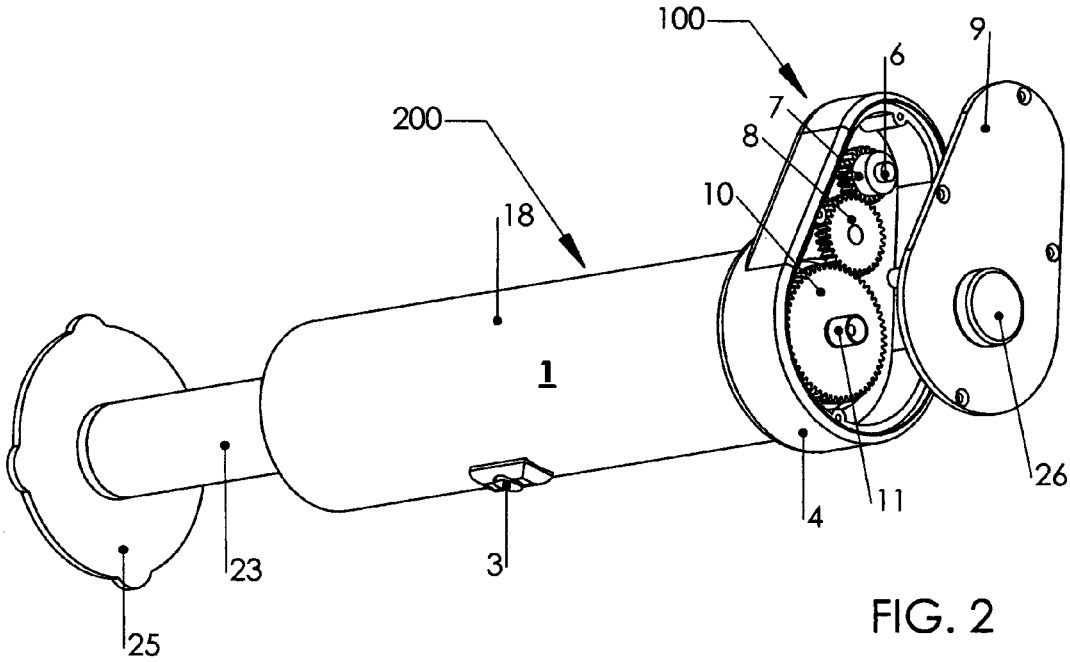
FIG. 2 shows a perspective view of an embodiment of the invention with the cover 9 of the gearbox exploded outwardly to reveal the gear train power transmission working components.

With reference to FIGS. 1 and 2, the power transmission assembly 1 comprises the key aspect of the invention and contains the majority of its parts. In its preferred form, it is comprised of two major subassemblies; a gearbox assembly 100 and a linear actuation assembly 200. The gearbox housing 4 is rigidly attached to the transmission housing 18 and together they maintain all their respective components in their proper working relationship. FIG. 2 shows the power transmission assembly 1 in its entirety with the gearbox cover 9 exploded to reveal the gear train. All these items are suitably fixed in place in working association with each other. The drive gear 7 is attached securely to the drive shaft 6, which is driven by the external power source. It in turn drives an idler gear 8, which revolves freely on a shaft molded into the inside of the gearbox. The idler gear 8 transmits the rotation to the driven gear 10. The driven gear otherwise turns freely on the driven gear shaft 11. A capture screw 26 secures the driven gear shaft through a suitable opening in the cover 9.

It will be obvious to anyone familiar with the art that other mechanisms could be employed to transmit the rotary energy from the drive shaft to the drive train mechanism contained inside the transmission housing 18. Belts and pulleys in a number of forms, frictional wheels, or even chain would all be effective for this purpose. However, the disclosed embodiment is presently the preferred one.

The transmission housing 18 is adapted to be secured at its distal end to the stand-off assembly 300. In the embodiment shown in the drawings (FIG. 1), this is done by means of a funnel connector 19, which is adapted at one end to attach to the transmission housing 18 and at its distal end to connect with the stand-off housing 20.

In the embodiment shown in the Figures, the drive shaft 6 and driven gear shaft 11 are both stainless steel and the gears and most other parts are molded plastic unless noted differently. Obviously, the choice of materials for all these components is large and varied.

The drive shaft 6 passes through the underside of the gearbox housing where it engages the drive gear as already discussed. As will be observed, the underside of the gearbox cover 9 is adapted to provide receiving holes for the metal shafts and, when held in place atop the gearbox housing 4 by the four screws (not shown), maintains stability in the shafts and close tolerances atop the gears (7,8 and 10 in FIG. 2) to keep them in place on their respective shafts.

Figure 3:
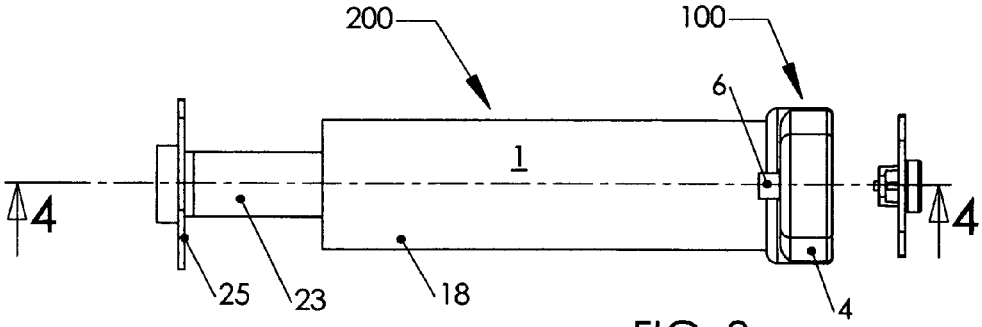
FIG. 3 is a rotated right side view of the device shown in FIG. 2.
Figure 4:
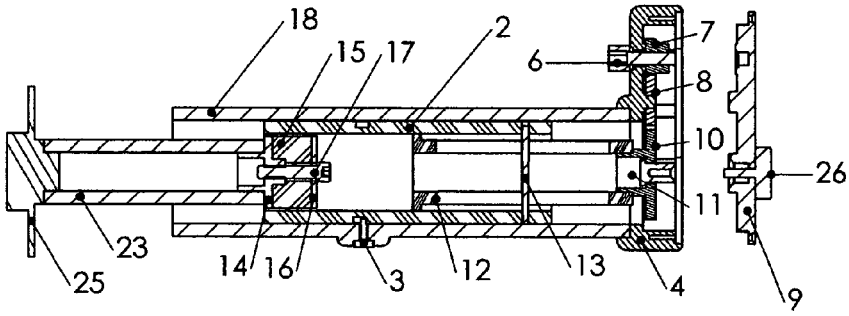
FIG. 4 is a cross-sectional view of the device shown in FIG. 2 as viewed along the line 4—4 in FIG. 3.

FIG. 3 is the rotated right side view of the power transmission assembly 100 and indicates the section line that gives rise to FIG. 4. FIG. 4 reveals the interaction between the gears and the remaining drive train components contained within the transmission housing 18. The driven gear 10 is affixed securely atop a transmission fork 12 and imparts rotational energy into it. Together the transmission fork 12 and the driven gear 10 are fixed in place laterally relative to the transmission housing 18 and the gearbox housing 4 by the driven gear shaft 11 and the capture screw 26. Also shown in FIG. 4 is the shuttle 2, which is the active component responsible for generating the linear motion.

Figure 5:
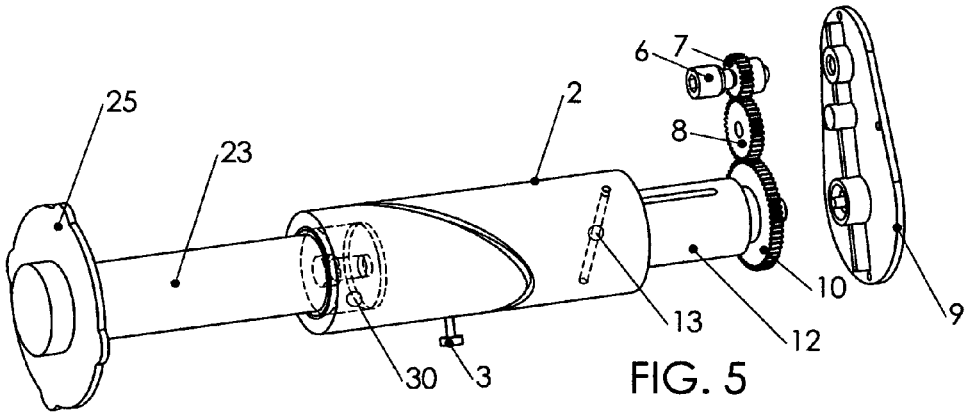
FIG. 5 is a reverse perspective view the device shown in FIG. 2 with the stand-off housing and other outer housing components removed so as to illustrate the power transmission and dual-motion aspects of the invention.

With reference to FIG. 5, it will be seen that the transmission fork 12 is slotted completely through along a portion of its length. The transmission fork 12 fits loosely and slidably inside the shuttle 2. A drive pin 13 is secured in two opposing holes along the centerline of the shuttle and passes through the slot in the fork 12 leaving the drive pin 13 free to move linearly within the slot in fork 12.

One can see then that, when the transmission fork is inserted into the shuttle 2 and the drive pin inserted through the holes in the shuttle and extending through the slot in the transmission fork, rotation of the laterally fixed transmission fork 12 is transmitted to the shuttle 2, but the shuttle is free to move linearly within the transmission housing 18. Depending on the choice of materials and their frictional and wear characteristics, it is possible that sleeve bearings (not shown) may be necessary for the inner surface to roll freely on the drive pin 13 and the outer surface to roll against the slot in the transmission fork 12.

The shuttle 2 is what imparts the linear motion to later components in the drive train. Cut into the outside surface of the shuttle, is a groove as indicated in FIG. 5. A cam follower 3 is mounted on the transmission housing 18 and is engaged inside the groove profile in the shuttle 2. Because the cam follower 3 is fixed linearly with regards to the transmission housing 18 (FIGS. 1–5), rotation of the shuttle 2 induced by the drive pin 13 then causes the shuttle 2 to move linearly within the transmission housing 18. The shuttle 2 when rotated will reciprocate linearly following the profile of the groove on the shuttle.

We note at this point that by removing the capture screw 26 and loosening the cam follower 3 so it no longer engages the groove in the shuttle 2, that the entire drive mechanism will slide free of the transmission housing 18. This provides for easy disassembly and cleaning of the machine. In fact, because the components are all stainless steel and plastic the device can be disassembled and placed in the dishwasher.

Figure 6:
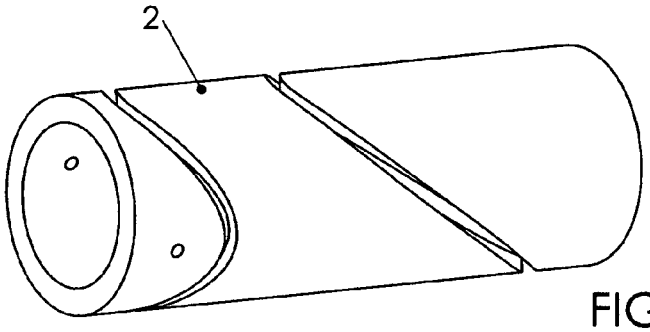
FIG. 6 shows the detail of a preferred form of shuttle having two different profiles for the cam follower grooves, each following a different path around the shuttle.

FIG. 6 shows the detail of a preferred form of shuttle. As indicated, a shuttle 2 is not limited to a single or simple groove profile. There could be multiple grooves following different paths around the shuttle causing different linear motion to be imparted. In fact a single circular groove would cause the shuttle to remain in a fixed linear position. Shown is a shuttle with two different profiles. To make use of multiple profiles on a single shuttle would require multiple holes in the transmission housing 18 capable of accepting the cam follower 3 so as not to exceed the freedom of motion afforded by the slots in the transmission fork 12. In one embodiment of this configuration, a flashlight-like sliding switch is mounted on the side of the transmission housing 18 and causes different cam followers to engage different slots while the machine is in motion, thereby allowing the user to quickly alternate between different linear actions. And of course the shuttle itself is easily removable. Thus, during a single use of a device according to the present invention, a user could interchange multiple shuttles having a variety of movement profiles.

Having brought up the possibility of complicated profiles on the shuttle, we should also point out the same is possible for the rotary motion. Remember the rotary motion delivered to the transmission fork 12 is provided externally, but the rotary motion imparted to the shuttle 2 could be transformed by altering the shape of the slots in the transmission fork in which the drive pin 13 travels. Were these slots made to trace a sinusoidal path, or the like, along their length, a rotational velocity oscillation, or "wobble", would result.

Returning to FIG. 4, we can see the mechanism by which the rotary and linear action of the shuttle 2 is carried down the drive train. A transmission extension 23 is affixed inside the other end of the shuttle by way of a clutch 15 and clutch washer 16. The clutch assembly is a very important safety component in the system protecting both the machine and the user. The clutch 15 is made of a pliable elastomer that when compressed by the clutch washer 16 will expand radially outwards to create frictional contact with the inside of the shuttle 2. The amount of friction is adjusted by means of the clutch screw 17 that threads into the clutch base 14. This in turn is attached rigidly to the top of the transmission extension 23. The adjustment is actually accomplished with a long screwdriver, which engages a slot (not shown) in the bottom of the clutch screw 17. Together these components (14–17) form the clutch assembly 30 whose position is indicated in hidden lines on FIG. 5.

If for any reason the transmission extension 23 or any down stream components affixed to it were prevented from moving while the machine was activated, the clutch would release to prevent damage to the machine or injury to the user. The release is effective in all directions and dimensions of motion. In the event the shuttle 2 was traveling down towards to user, and the business end were prevented from doing so, the clutch could release and slide up inside the shuttle 2 until encountering the fixed transmission fork 12 at the other end which is equivalent to the fully retracted state of the machine.

In the alternate case, where the shuttle is retracting and moving away from the user, if any problem caused the downstream mechanisms to resist following it, the clutch will release and simply pull free from the shuttle. And lastly, in the event of two much rotary resistance, the clutch will release rotationally.

Figure 7:
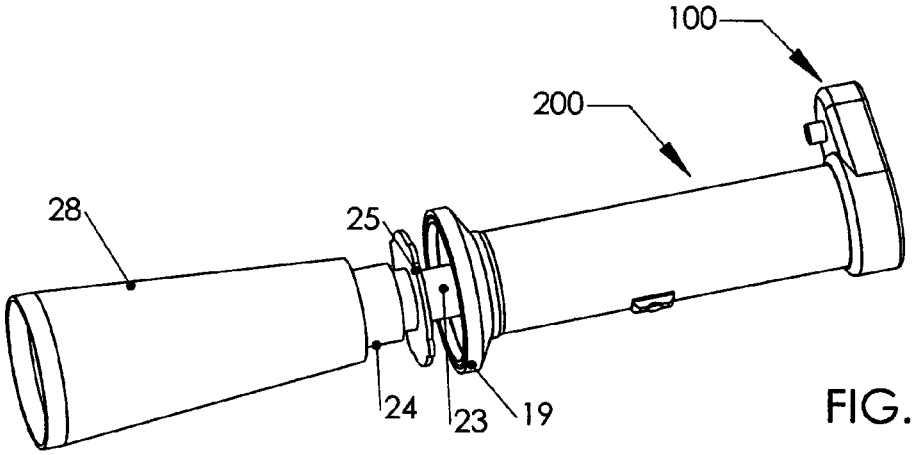
FIG. 7 shows a perspective view of the detail of a preferred form of stand-off assembly with the housing 20 removed.

The device shown in FIG. 7 is much like that in FIG. 1 with the stand-off housing 20 removed and configured with a male stimulator 28 (not part of the invention). The stand-off assembly 300 serves to keep the operating components of the machine safely away from the user. Inside the stand-off assembly 300, a universal adapter 25 is affixed to the distal end of the transmission extension 23 and moves in synchrony with it. It is this piece to which specific devices will be attached to activate various masturbation devices. Obviously, the only requirements of the universal adapter 25 is that it fit securely on the end of the transmission extension 23, as shown in FIG. 7 and be adapted to connect with and transmit its movement to a suitable selected stimulation device such as the male stimulator 28 that is shown in FIG. 7. Different specific device adapters 24 to be affixed to the universal adapter 25 are available for both male and female sexual stimulation devices (27 in FIG. 1 or 28 as in FIG. 7).

While rotational stimulation is satisfying to many users as a novel stimulus, there is nothing natural about rotation in the act of intercourse. The universal adapter 25 is always rotating and following the linear profile (if any) of the shuttle 2. The device adapters 24 can be affixed to the universal adapter 25 by way of a free-turning shaft that allows the final motion imparted to the user to be only linear. In combination then of various shuttle profiles and fixed or free-turning attachment of the device adapters, the user can select any combination of rotation, reciprocation, or both.

Figure 8:
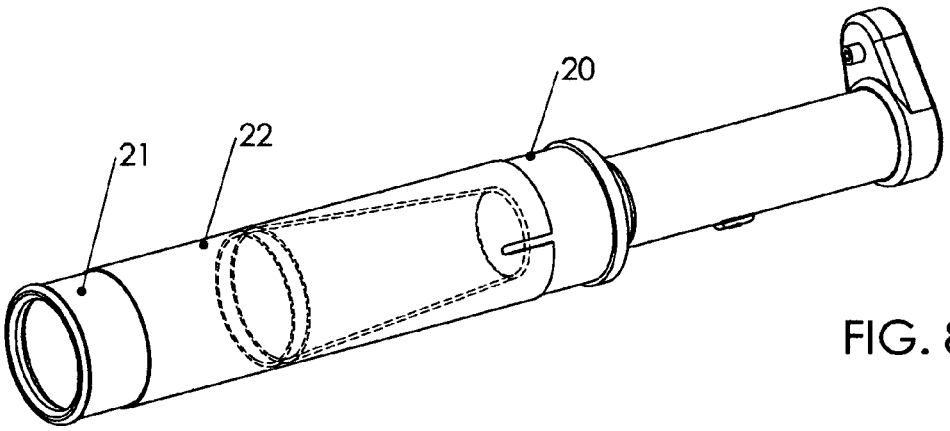
FIG. 8 illustrates the expanded stand-off assembly of FIG. 7 configured to carry a male masturbation device (not shown) and having the protective housing in place.

FIG. 8 illustrates the expanded stand-off assembly configured to carry a male masturbation device 28 (not part of the invention). There are two additional components. There is a stand-off extender 22 which slips over the female stand-off housing 20. This enables the user to adjust the depth of the masturbation device within the overall assembly. Once the adjustment is made, the stand-off extender 22 can be set in place snuggly with relation to the female stand-off housing 20 by way of a belt (not shown) that compresses it around the inner stand-off housing 20. Finally, a male safety sleeve 21 slides freely inside the end of stand-off extender 22. The safety sleeve is constructed essentially the same as the female stand-off housing 20, but serves a different purpose. The male masturbation device 28 moves freely inside the male safety sleeve 21, which is held concentric with the female stand-off tube 20 by way of the stand-off extender 22. The safety sleeve 21 protects the male user from being pinched between the male masturbation device 28 and any component of the stand-off assembly 300. Were the user to be pinched here, the male safety sleeve would simply slide out in unison with the masturbation device preventing injury to the user.

The present invention described herein, therefore, is well adapted to carry out the objects and attain the ends and advantages mentioned, as well as others inherent therein. While a presently preferred embodiment of the invention has been described for purposes of disclosure, numerous changes in the details of procedures may be made for accomplishing the desired results. For example, the embodiment illustrated in the drawings derives all forms of motion by strictly mechanical interaction of the shuttle 2, the transmission fork 12, and the cam follower 3. In a different embodiment the action of the shuttle could be electromagnetically induced. The gear train and transmission fork 12 could be eliminated while the rest of the drive train safety mechanisms remain effective. Electromagnetically actuating the shuttle would provide nearly limitless versatility of motion by use of inexpensive internal or external computer programmable controllers, and would allow even greater safety. Feedback from the power source could instantly disable the machine when resistance to motion in any direction caused the current draw to exceed some threshold.

It will also be apparent that the diameter and length of the shuttle and transmission tube could be made large enough such that the shuttle itself could carry a male masturbation sleeve. In such an embodiment the standoff assemblies are not necessary, therefore a shorter device is made possible at the expense of broader and somewhat heavier machine whose operation and activation would otherwise be identical. Further, a collection vessel may be included with such a male-configured device so as to collect semen. In this way, the device of the present invention could be used in animal breeding programs.

As described above, in the preferred embodiment, the linear reversing actuation is effected by way of the cam follower moving along one or mole grooves in the outside surface of the rotating shuttle. It should be evident that the system would work equally well with the groove on the inside of the tube and the cam follower attached to the shuttle. Another alternative for a linear reversing actuator would be a mechanism not unlike the commercially available level-wind systems found on casting type fishing reels (sometimes known as a diamond-reverser).

These and other similar modifications will readily suggest themselves to those skilled in the art, and are intended to be encompassed within the spirit of the present invention disclosed herein and the scope of the appended claims.

What is claimed is:

1. A lightweight portable apparatus for producing simultaneous rotating and linearly reciprocating motion and transmitting such motion to a suitable self stimulation masturbation device, said apparatus comprising:

a power transmission assembly including a drive shaft;

connection means associated with the drive shaft adapted to enable rotatable connection of the drive shaft to an external rotating power source; and attachment means affixed to the distal end of said drive shaft and adapted to attach to and transmit motion from the drive shaft to a selected suitable self stimulation device;

said power transmission assembly comprising, a linear actuation assembly operatively coupled to the drive shaft; and rotary energy transmission means associated with said drive shaft to transmit rotary energy from the drive shaft to the linear actuation assembly;

said linear actuation assembly comprising;

a transmission fork fixedly attached to said drive shaft; and a cammed shuttle connected to said transmission fork and adapted to receive rotational energy therefrom;

a cam follower engage with said cammed shuttle to induce linear reciprocation of the shuttle within a confined space as it rotates.

2. The apparatus according to claim 1, wherein the power transmission assembly includes a gearbox assembly containing at least two gears and the linear actuation assembly includes a clutch assembly.

3. The apparatus according to claim 1, wherein the attachment means includes a universal adapter suitable to receive and attach to a multiplicity of self stimulation devices.

4. The apparatus according to claim 1, wherein a stand-off assembly is included adapted to safely separate the user from the operating components of the power transmission assembly and the stimulation device and comprises a tube adapted to be secured in place at the distal end of the power transmission assembly.

5. A device according to claim 4, wherein the stand-off assembly further comprises a stand-off extender adapted to slip over the outside of the stand-off tube to enable the user to linearly position the masturbation device within the overall assembly;

said stand-off extender being adapted to be locked in place after adjustment.

6. The device according to claim 5, wherein said stand-off assembly for the male configuration is longer than that for the female configuration.

7. The apparatus according to claim 1, wherein the linear actuation assembly comprises:

a generally tube-shaped outer protective transmission housing connected to and surrounding said drive shaft and directly associated therewith;

a drive train mechanism also within said transmission housing and adapted to receive rotary motion from the drive shaft;

an oscillating shuttle adapted to fit within the transmission housing and to move linearly therein, said shuttle having at least one cam groove cut into the outer surface thereof;

at least one cam follower fixedly mounted on the transmission housing and adapted to engage said at least one cam groove in the shuttle and thereby induce linear reciprocation of the shuttle following the profile of the cam groove when the shuttle rotates;

a rotatable transmission fork located within the linear shuttle and fixed in place laterally relative to the transmission housing and fixedly attached to said second means to receive rotational energy therefrom;

said transmission fork being adapted such that rotation of the laterally fixed transmission fork is transmitted to the shuttle, but the shuttle is still free to move linearly within the transmission housing.

8. The device according to claim 1, wherein the action of the shuttle is electromagnetically induced.

9. The device according to claim 1, wherein the action of the shuttle is entirely mechanically induced.

10. The device according to claim 1, wherein the transmission and shuttle assemblies are made longer and larger radially such that the shuttle itself is capable of carrying a male masturbation sleeve internal to that component as well as being adaptable to actuating female devices by way of a reducing adapter.

11. A lightweight portable apparatus for producing simultaneous rotating and linearly reciprocating motion and transmitting such motion to a suitable self stimulation masturbation device comprising:

a power transmission assembly including a drive shaft;

connection means associated with the drive shaft to enable rotatable connection of the drive shaft to an external rotating power source and a universal adapter affixed to the distal end of the power transmission assembly so as to move in synchrony with the active components of said power transmission assembly, said universal adapter being adapted to connect with and transmit those movements to a suitably selected stimulation device, said power transmission assembly comprising a generally tube-shaped outer protective transmission housing a drive shaft within said transmission housing and directly associated therewith;

a drive train mechanism within said transmission housing and adapted to receive rotary motion from the drive shaft;

second means associated with said drive shaft to transmit rotary energy from the drive shaft to the drive train mechanism;

said drive train mechanism comprising a shuttle adapted to fit within the transmission housing and to move linearly therein;

a rotatable transmission fork coaxially coupled with said shuttle and connected to the transmission housing and fixedly attached to said second means to receive rotational energy therefrom;

said transmission fork being adapted such that rotation of the laterally fixed transmission fork is transmitted to the shuttle, while said shuttle is free to move linearly within the transmission housing, and housing of the power transmission assembly.

12. The device according to claim 11, further comprising a stand-off assembly securable on the distal end of the protective transmission housing of the power transmission assembly and adapted to safely separate the user from the operating components of the power transmission assembly and the stimulation device.

13. The device according to claim 11, wherein a transmission extension is fixedly connected inside the distal end of the shuttle and extending outside the shuttle, said connection being by way of a clutch assembly, including a compressible elastomer o-ring and a hard, solid clutch washer such that when compressed by the clutch washer, the o-ring will expand radially outwards to create frictional contact with the inside of the shuttle.

14. The device according to claim 13, wherein the clutch assembly includes a clutch base attached rigidly to the top of the transmission extension and a clutch screw threaded into said clutch base where the amount of frictional contact between the 0-ring and the clutch washer is adjusted by threading the clutch screw into the clutch base.

* * * * *